US009096373B2

(12) United States Patent
Rondelli

(10) Patent No.: US 9,096,373 B2
(45) Date of Patent: Aug. 4, 2015

(54) CAPSULE FOR INFUSION PRODUCTS

(71) Applicant: MACCHIAVELLI S.R.L., San Lazzaro di Savena (IT)

(72) Inventor: Raffaele Rondelli, Argelato (IT)

(73) Assignee: MACCHIAVELLI S.R.L., San Lazzaro di Savena (IT)

( * ) Notice: Subject to any disclaimer, the term of this patent is extended or adjusted under 35 U.S.C. 154(b) by 0 days.

(21) Appl. No.: 14/382,861

(22) PCT Filed: Mar. 5, 2013

(86) PCT No.: PCT/IB2013/051747

§ 371 (c)(1),
(2) Date: Sep. 4, 2014

(87) PCT Pub. No.: WO2013/132435

PCT Pub. Date: Sep. 12, 2013

(65) Prior Publication Data

US 2015/0021209 A1 Jan. 22, 2015

(30) Foreign Application Priority Data

Mar. 5, 2012 (IT) ..... BO2012A0103

(51) Int. Cl.
*B65B 29/02* (2006.01)
*A47J 31/06* (2006.01)
*B65D 85/804* (2006.01)

(52) U.S. Cl.
CPC ..... *B65D 85/8043* (2013.01)

(58) Field of Classification Search
CPC ..... B65D 85/7043; B65D 85/808
USPC ..... 99/279, 295, 306, 323; 206/0.5; 210/474, 475; 220/359.1, 359.2, 366.1, 220/367.1, 371; 426/77, 82, 112, 115, 425, 426/431, 433
See application file for complete search history.

(56) References Cited

U.S. PATENT DOCUMENTS 7,213,506 B2 * 5/2007 Halliday et al. ..... 99/295
7,287,461 B2 * 10/2007 Halliday et al. ..... 99/295

(Continued)

FOREIGN PATENT DOCUMENTS

EP 1792850 6/2007
WO WO 93/17932 9/1993

OTHER PUBLICATIONS

International Search Report and Written Opinion from International Application No. PCT/IB2013/051747 mailed Jul. 5, 2013.

*Primary Examiner* — Luan K Bui
(74) *Attorney, Agent, or Firm* — Dorsey & Whitney LLP

(57) ABSTRACT

The capsule comprises a cup-shaped body defined by a bottom wall and by a side wall, a lid arranged so as to close body and an annular shoulder defined on the inner face of wall and on which the peripheral edge of lid is fixed. Side wall of body has an upper annular edge defined by:

an annular portion extending upwards in one piece with side wall;

an annular portion extending from portion on a horizontal plane;

an annular portion extending from portion on a horizontal plane;

an annular projection extending downwards from the lower face of portion for defining, together with the outer face of portion, an annular seat suited to be engaged by the upper end of a side wall of a percolation chamber; and a ring connecting portions and which, in section, is arched and has a concavity facing downwards.

8 Claims, 2 Drawing Sheets

(56) References Cited

U.S. PATENT DOCUMENTS

| | | | | |
|---|---|---|---|---|
| 7,543,527 | B2 * | 6/2009 | Schmed | 99/295 |
| 8,230,775 | B2 * | 7/2012 | Vanni | 99/295 |
| 2005/0266122 | A1 * | 12/2005 | Franceschi | 426/77 |
| 2008/0148958 | A1 * | 6/2008 | Koeling et al. | 99/323 |
| 2010/0203208 | A1 * | 8/2010 | Yoakim et al. | 426/431 |
| 2012/0118166 | A1 * | 5/2012 | Macchi | 99/295 |
| 2012/0196008 | A1 * | 8/2012 | York | 99/295 |

* cited by examiner

CAPSULE FOR INFUSION PRODUCTS

TECHNICAL FIELD

The present invention concerns a capsule for the infusion of granular products, powdered or in leaves, such as e.g. coffee, barley, powdered milk, tea, chamomile tea, etc.

BACKGROUND ART

Generally, the capsules for infusion products comprise a cup made of a plastic material, within which the infusion product is arranged, and a lid, also made of plastic material and arranged so that it closes the cup. The peripheral edge of the lid is welded to the upper edge of the cup by means of an apparatus of a known type, e.g. for generating ultrasounds, which carries out the welding by means of vibrations. When the capsule is inserted inside a percolation chamber of a machine dispensing drinks, hot water is injected under pressure and passes through at least one hole pierced in the lid to be mixed with the infusion product inside the cup. Then the drink comes out of the cup through at least one hole pierced in the bottom wall of the cup. In some percolator machines the capsule is arranged so that the hot water enters through the hole pierced in the bottom wall of the cup and leaves through the hole pierced in the lid.

The aforesaid capsules have a plurality of drawbacks.

In particular, during the percolation step, the upper edge of the cup is pressed between an upper body and a lower body defining the percolation chamber. In spite of this pressure, the percolation chamber does not guarantee a perfect hydraulic seal and therefore a portion of the injected water leaks out of the percolation chamber, exactly through the space defined between the two bodies of the percolation chamber pressing the upper edge of the cup between them. In order to improve the hydraulic seal, some producers use layers made of different materials to be glued on the upper and/or the lower face of the edge of the cup.

DISCLOSURE OF INVENTION

The aim of the present invention is providing a capsule for the infusion of granular products, powdered or in leaves, which lacks the aforesaid drawbacks and has a lid and an upper edge of the cup having a particular shape allowing a correct and effective hydraulic seal of the percolation chamber during the percolation step.

According to the present invention, it is provided a capsule for infusion products comprising:

a cup-shaped body made of a plastic material defined by a bottom wall and by a first side wall;

a lid made of plastic material arranged so that it closes said cup-shaped body;

an annular shoulder defined on the inner face of said first side wall and on which the peripheral edge of said lid is fixed;

characterised in that said first side wall has an upper annular edge comprising:

a first annular portion extending upwards in one piece with said first side wall;

a second annular portion extending from said first portion and defined on a substantially horizontal plane;

a third annular portion extending from said second portion and defined on a substantially horizontal plane;

an annular projection extending downwards from the lower face of said second portion so as to define, with the outer face of said first portion, an annular seat which is suited to be engaged by the upper end of a second side wall of a percolation chamber; and a connection ring connecting said second and third portions and which, in a section view, is arched and has a concavity facing downwards.

BRIEF DESCRIPTION OF THE INVENTION

For a better understanding of the present invention it is described hereinafter an embodiment given for mere illustrative and not limitative purposes, with a reference to the annexed figures, wherein.

BEST MODE FOR CARRYING OUT THE INVENTION

Figure 2:
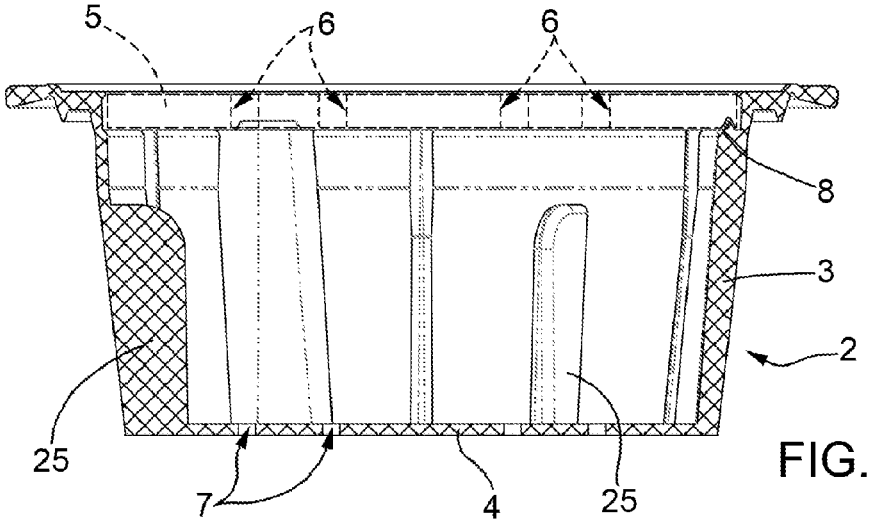
FIG. 2 is a view according to section II-II of FIG. 1.
Figure 1:
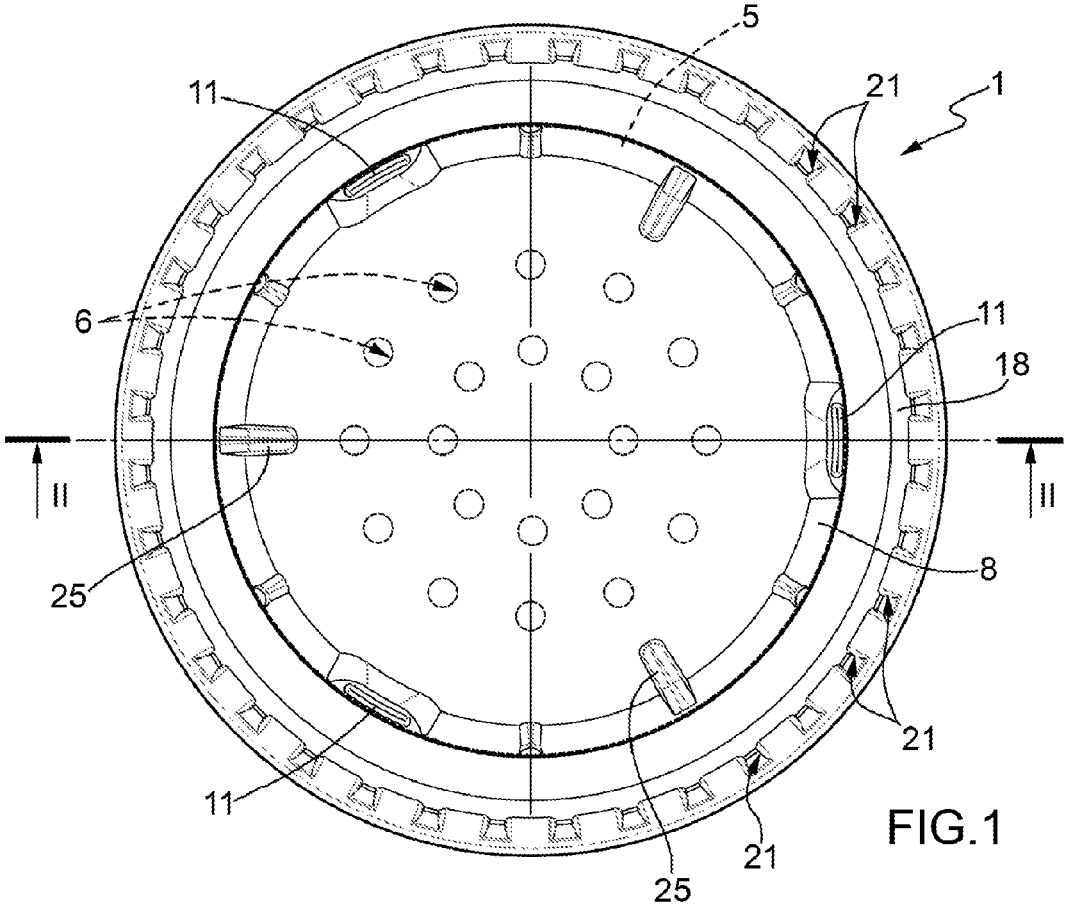
FIG. 1 is a plant view of a cup-shaped body of a capsule produced according to the principles of the present invention.

In the enclosed FIGS. 1 and 2 a preferred embodiment of the capsule for infusion products according to the present invention is shown as a whole with reference number 1; capsule 1 is suited to be inserted in a percolation chamber and is suited to contain an infusion product. Capsule 1 comprises a cup-shaped body 2 made in one piece of a plastic material, having a slightly truncated-cone shape and defined by a side wall 3 and by a bottom wall 4. Capsule 1 further comprises a lid 5 (shown in dashed lines in FIG. 2) made of plastic material and fixed by interlocking or welding on the upper part of the cup-shaped body 2. In the shown example both the lid 5 and the bottom wall 4 have respective holes 6 and 7 through which the hot water enters and the drink leaves the cup-shaped body 2. It is evident that lid 5 and bottom wall 4 could have, rather than holes 6 and 7, some valves suited to open respective holes by means of water pressure, or lid 5 and bottom wall 4 could be pierced by suitable means present in the percolation chamber for creating the aforesaid holes.

Side wall 3 has, in correspondence of its own upper end, an inner shoulder 8 on which the peripheral edge of lid 5 abuts. Furthermore, some projections 11 extend upwards from shoulder 8. In use, lid 5 is welded on shoulder 8 by means of a device of a known type suited to generate ultrasounds for fluidizing the material undergoing these ultrasounds and in particular for fluidizing the material forming the projection 11; as known, these vibrations induce a temperature increase in the underlying areas and therefore a fusion of the plastic material. As a consequence lid 5 is welded on shoulder 8.

Figure 4:
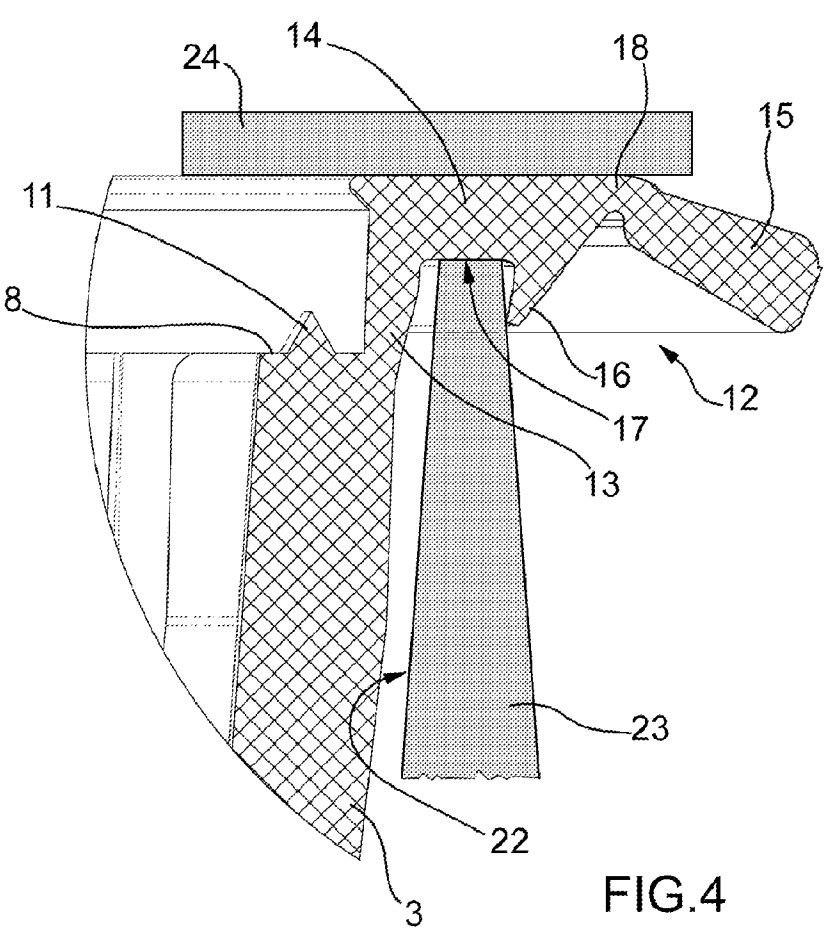
FIG. 4 is a view of the portion shown in FIG. 3 undergoing a pressure by means of the elements of the percolation chamber.
Figure 3:
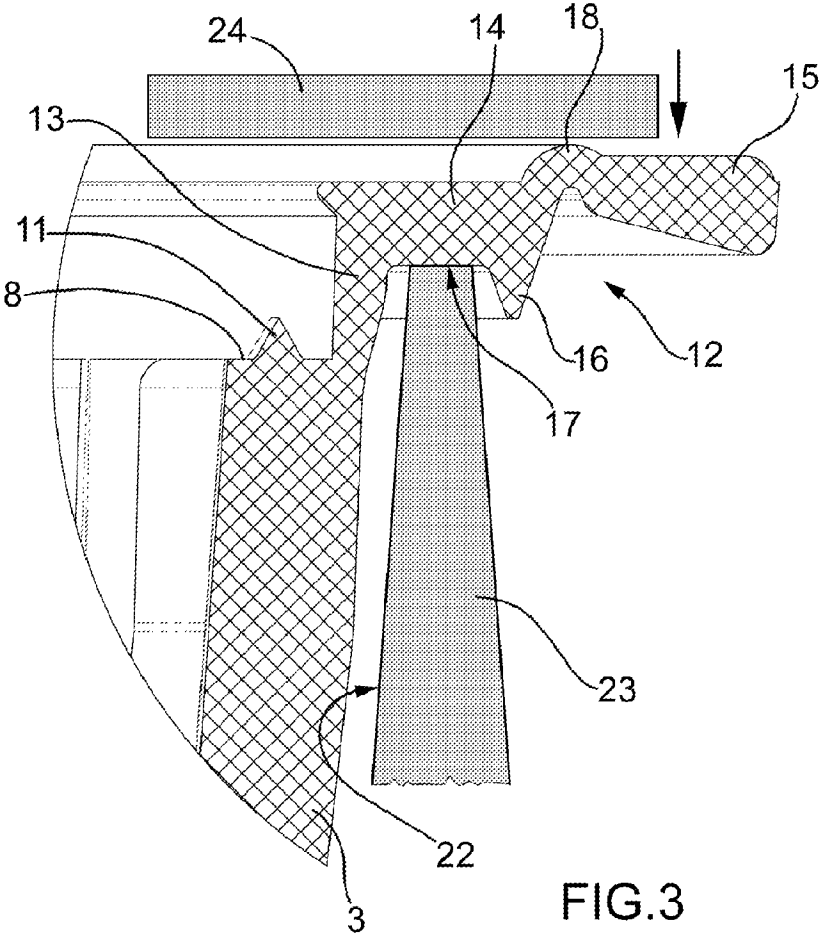
FIG. 3 is an enlarged view of a portion of the cup-shaped body shown in FIG. 2 and showing the elements of a percolation chamber.

With a reference to FIGS. 3 and 4, above shoulder 8 the cup-shaped body 2 has an annular edge 12 made of an elastically deformable plastic material and sequentially showing a first annular portion 13 extending upwards in one piece with side wall 3, a second annular portion 14 defined on a substantially horizontal plane and a third annular portion 15 defined on a substantially horizontal plane. The inner face of portion 13 together with the shoulder defines the annular seat wherein the peripheral edge of lid 5 is then fixed. An annular projection 16 extends downwards from the lower face of portion 14, said projection 16 defining together with the outer face of portion 13 an annular seat 17 open downwards; projection 16 showing in section a thickness decreasing downwards. A connection ring 18 is arranged between portion 14 and portion 15, said ring being arched in section and having a concavity facing downwards. Moreover, the upper face of ring 18 is arranged at a higher level if compared to the upper face of portion 14. The portion 15 has its own upper face at an intermediate level between the upper face of portion 14 and the upper face of ring 18. Furthermore, portion 15 has an increasing thickness starting from ring 18. Finally, as shown in FIG. 1, a plurality of radial indentations 21 evenly distributed along portion 15 is provided on the upper face of said portion 15.

Referring now to FIGS. 3 and 4 the percolation chamber not shown in its totality has a seat 22 defined by a not shown basis wall (suitably pierced) and by a side wall 23 whose upper end has a flat and horizontal face and engages seat 17 abutting with the aforesaid end face against the lower face of portion 14. The percolation chamber has an upper plate 24 (suitably pierced) mobile between a rest position, shown in FIG. 3, and a working position, shown in FIG. 4. Plate 24 passing from the rest position to the working position presses edge 12 of cup-shaped body 2 against the upper end of wall 23. In use, plate 24 touches first the upper face of ring 18 and then the upper face of portion 14. During the downward translation of plate 24 the ring 18 is deformed and its upper face becomes substantially flat and on the same plane of the upper face of portion 14. Ring 18 substantially acts as a hinge determining the rotation of projection 16 towards wall 23 until the lower end of projection 16 abuts against the outer surface of wall 23. In the working position plate 24 abuts against the upper surface of portion 14 and of ring 18, whereas portion 15 also rotates towards wall 23. With a reference to FIG. 4 it can be noticed that it is provided a tight stop of plate 24 on the upper face of portion 14 and of ring 18, a tight stop of the lower face of portion 14 on the upper end of wall 23 and a tight stop of the lower end of projection 16 on the outer face of wall 23. Now, it is clear that the pressure exerted by plate 24 on edge 12 towards wall 23 creates an effective hydraulic sealing which avoids any leakage of fluid from the inside of capsule 1 to the inside and the outside of the percolation chamber.

Finally, with a reference to FIGS. 1 and 2, ribs 25 are formed in one piece on the inner face of wall 3, said ribs extending up to bottom wall 4 and substantially strengthening wall 3 so that this latter is not deformed during the translation of plate 24 to its working position. Preferably, cup-shaped body 2 and/or lid 5 are made of PET and/or PP which, as known, are plastic materials belonging to the family of polyolefins. Moreover, the whole capsule 1 is preferably made of a biodegradable plastic material which, as known, is defined by a plastic material suitably additivated with known substances or, as an alternative, is made using biopolymers which make capsules 1 biodegradable.

The aforesaid capsule 1 has a plurality of advantages.

In particular, the upper edge of the side wall of the cup-shaped body is shaped so that it avoids any leakage of liquid to the outside of the percolation chamber. This effective hydraulic seal was obtained by making this edge in one piece with the cup-shaped body, unlike other known capsules wherein layers of different materials are glued to the edge, with all the resulting costs.

Moreover, this particular shape allows the optimal maintenance of the hydraulic seal even when the percolation chamber of the dispensing machine is worn out, maintaining the supply and safety performances of the products capsules.

The invention claimed is:

1. A capsule for infusion products, the capsule comprising:

a cup-shaped body made of a plastic material, the cup-shaped body defined by a bottom wall and a first side wall having an inner face;

a lid made of a plastic material and including a peripheral edge, the lid arranged so as to close the cup-shaped body; and an annular shoulder defined on the inner face of the first side wall and on which the peripheral edge of the lid is fixed;

wherein the first side wall has an upper annular edge providing:

a first annular portion extending upwards in one piece with the first side wall, the first annular portion including an outer face;

a second annular portion extending from the first annular portion and defined on a substantially horizontal plane, the second annular portion including a lower face;

a third annular portion extending from the second annular portion and defined on a substantially horizontal plane;

an annular projection extending downwards from the lower face of the second annular portion so as to define, with the outer face of the first annular portion, an annular seat suitable to be engaged by an upper end of a second side wall of a percolation chamber; and a connection ring connecting the second and third annular portions and which, in section, is arched and has a concavity facing downwards.

2. The capsule according to claim 1, wherein the connection ring includes an upper face that, in a rest position, is arranged at a higher level with respect to the upper face of the second annular portion and, in use, following a pressure of a plate, the percolation chamber substantially reaches the same level of the upper face of the second annular portion.

3. The capsule according to claim 2, wherein the annular projection, in section, has a thickness decreasing downwards.

4. The capsule according to claim 1, wherein the third annular portion has, in a rest position, an upper face arranged at an intermediate level between the upper face of the second annular portion and an upper face of the connection ring; the third annular portion having an increasing thickness starting from the connection ring.

5. The capsule according to claim 4, wherein the upper face of the third annular portion includes a plurality of radial indentations thereon.

6. The capsule according to claim 1, wherein the upper annular edge is made in one piece together with the cup-shaped body.

7. The capsule according to claim 6, wherein the upper annular edge is made of an elastically deformable plastic material.

8. The capsule according to claim 1, wherein the inner face of the first side wall includes reinforcement ribs thereon that are made in one piece, the reinforcement ribs extending up to the bottom wall.

* * * * *